US009326622B2

(12) United States Patent
Toth

(10) Patent No.: US 9,326,622 B2
(45) Date of Patent: May 3, 2016

(54) BLOCK SYSTEM AND METHOD

(71) Applicant: Jason Allen Toth, San Diego, CA (US)

(72) Inventor: Jason Allen Toth, San Diego, CA (US)

( * ) Notice: Subject to any disclaimer, the term of this patent is extended or adjusted under 35 U.S.C. 154(b) by 0 days.

(21) Appl. No.: 14/682,517

(22) Filed: Apr. 9, 2015

(65) Prior Publication Data

US 2015/0342373 A1 Dec. 3, 2015

Related U.S. Application Data

(60) Provisional application No. 62/007,334, filed on Jun. 3, 2014.

(51) Int. Cl.

| | |
|---|---|
| ***E04B 1/38*** | (2006.01) |
| ***A47G 1/16*** | (2006.01) |
| ***A47G 1/06*** | (2006.01) |
| ***A47G 1/08*** | (2006.01) |

(52) U.S. Cl.

CPC .. *A47G 1/16* (2013.01); *A47G 1/06* (2013.01); *A47G 1/065* (2013.01); *A47G 1/08* (2013.01); *Y10T 29/49948* (2015.01); *Y10T 29/49964* (2015.01); *Y10T 428/192* (2015.01)

(58) Field of Classification Search

CPC ..... E04F 13/072; E04F 13/08; E04F 13/0801; E04F 13/0862; E04F 13/0871; E04F 13/10; E04F 13/22; E04F 13/24; E04F 13/26

See application file for complete search history.

(56) References Cited

U.S. PATENT DOCUMENTS

| | | | | |
|---|---|---|---|---|
| 841,998 | A * | 1/1907 | Mulford | E04F 15/02 52/584.1 |
| 5,106,250 | A * | 4/1992 | Fischer | E04F 13/0835 411/107 |
| 7,836,651 | B2 * | 11/2010 | Krupnick | B29C 70/025 52/311.1 |
| 7,877,948 | B2 * | 2/2011 | Davies | B60R 13/01 411/354 |
| 8,171,690 | B2 * | 5/2012 | Ghatikar | E04F 13/0837 403/267 |
| 2004/0056172 | A1 * | 3/2004 | Sedran | E04G 9/05 249/189 |

* cited by examiner

*Primary Examiner* — Patrick Maestri

(74) *Attorney, Agent, or Firm* — Procopio Cory Hargreaves and Savitch LLP; Stephen C. Beuerle

(57) ABSTRACT

A block system includes a plurality of blocks connected side by side into a configuration, each block including a front, a rear, sides, lips, and fastener accommodating spaces; a plurality of adjacent fasteners connecting side by side blocks together. Each fastener disposed in the fastener accommodating spaces of side by side blocks without overlapping adjacent fasteners.

20 Claims, 9 Drawing Sheets

BLOCK SYSTEM AND METHOD

CROSS REFERENCE TO RELATED APPLICATION

This application claims priority to U.S. Provisional Patent Application 62/007,334, filed Jun. 3, 2014, which is incorporated by reference herein.

FIELD OF THE INVENTION

This invention relates to block systems and methods.

SUMMARY OF THE INVENTION

An aspect of the invention involves a block system including a plurality of blocks connected side by side into a configuration, each block including a front, a rear, sides, lips, and fastener accommodating spaces; a plurality of adjacent fasteners connecting side by side blocks together. Each fastener disposed in the fastener accommodating spaces of side by side blocks without overlapping adjacent fasteners.

One or more implementations of the above aspect of the invention include one or more of the following: the block is made of at least one of a wood material and a plastic material; the block is made of a wood material and milled from at least one of a wooden blank and a plywood blank in which a circular inner recess, a rectangular outer recess, and edge recesses are created from a subtractive process on a CNC machine; the fasteners are binder clips that clip together adjacent lips of adjacent blocks for clipping the plurality of blocks together in the side by side configuration; each binder clip include a clip an elongated clip member with a substantially triangular cross section and terminal ends, and a pair of key-hole shaped handles pivotally connected to terminal ends of the clip member; the fastener accommodating spaces receive the key-hole shaped handles of the binder clips without overlapping adjacent key-hole shaped handles of adjacent fasteners; the block system includes perpendicularly disposed blocks, and the fastener accommodating spaces receive the key-hole shaped handles of the binder clips without overlapping adjacent key-hole shaped handles of adjacent fasteners and so that the key-hole shaped handles of binder clips connecting perpendicularly disposed blocks are perpendicularly disposed relative to each other without contacting each other; the block system includes a wall cleat with a flange and a cleat portion having an angled wall and a hole for receiving a threaded fastener for mounting the wall cleat to a wall, each block including an angled wall that defines a circular inner recess that operatively corresponds with the angled wall of the circular inner recess block to lock the block and wall cleat together by the combined forces of gravity and friction; the cleat portion is circular and the hole is centrally disposed in the cleat portion; the cleat portion is elliptical and the hole is offset from center in the cleat portion; the front of each block includes at least one of images, numbers, letters, symbols, logos, characters, and indicia adhered to the front by at least one of transfer sheeting and direct printing, the front of each block is solid and the rear of each block includes the fastener accommodating spaces, the blocks include rectangular blocks; and/or the blocks include square blocks.

Another aspect of the invention involves a method of using the block system of the above aspect of the invention, including aligning a plurality of the blocks rear face up side by side into the configuration; and connecting the side by side blocks together with the plurality of adjacent fasteners so that the fasteners are disposed in the fastener accommodating spaces of side by side blocks without overlapping adjacent fasteners.

One or more implementations of the immediately above aspect of the invention include one or more of the following: the block system includes at least one wall cleat with a flange and a cleat portion having an angled wall and a hole for receiving a threaded fastener for mounting the at least one wall cleat to a wall, each block includes an angled wall that defines a circular inner recess that operatively corresponds with the angled wall of the circular inner recess block, the method further including: mounting the at least one wall cleat to the wall with the threaded fastener; mounting the block system to the wall by disposing the wall cleat in the circular inner recess of the block so that the angled wall defining the circular inner recess locks the block and wall cleat together by the combined forces of gravity and friction; the block is made of at least one of a wood material and a plastic material; the block is made of a wood material and milled from at least one of a wooden blank and a plywood blank in which a circular inner recess, a rectangular outer recess, and edge recesses are created from a subtractive process on a CNC machine; the fasteners are binder clips that clip together adjacent lips of adjacent blocks for clipping the plurality of blocks together in the side by side configuration; each binder clip include a clip an elongated clip member with a substantially triangular cross section and terminal ends, and a pair of key-hole shaped handles pivotally connected to terminal ends of the clip member; the fastener accommodating spaces receive the key-hole shaped handles of the binder clips without overlapping adjacent key-hole shaped handles of adjacent fasteners; the block system includes perpendicularly disposed blocks, and the fastener accommodating spaces receive the key-hole shaped handles of the binder clips without overlapping adjacent key-hole shaped handles of adjacent fasteners and so that the key-hole shaped handles of binder clips connecting perpendicularly disposed blocks are perpendicularly disposed relative to each other without contacting each other; the cleat portion is circular and the hole is centrally disposed in the cleat portion; the cleat portion is elliptical and the hole is offset from center in the cleat portion; the front of each block includes at least one of images, numbers, letters, symbols, logos, characters, and indicia adhered to the front by at least one of transfer sheeting and direct printing, the front of each block is solid and the rear of each block includes the fastener accommodating spaces, the blocks include rectangular blocks; and/or the blocks include square blocks.

BRIEF DESCRIPTION OF DRAWINGS

The details of the present invention, both as to its structure and operation, may be gleaned in part by study of the accompanying drawings, in which like reference numerals refer to like parts, and in which.

DETAILED DESCRIPTION OF THE INVENTION

Figure 1A:
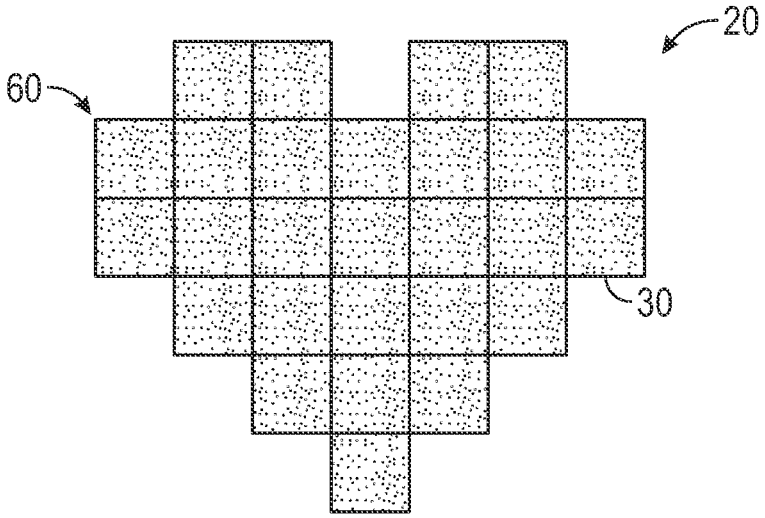
FIG. 1A is a front elevational view of an embodiment of a block system in an example configuration.
Figure 1B:
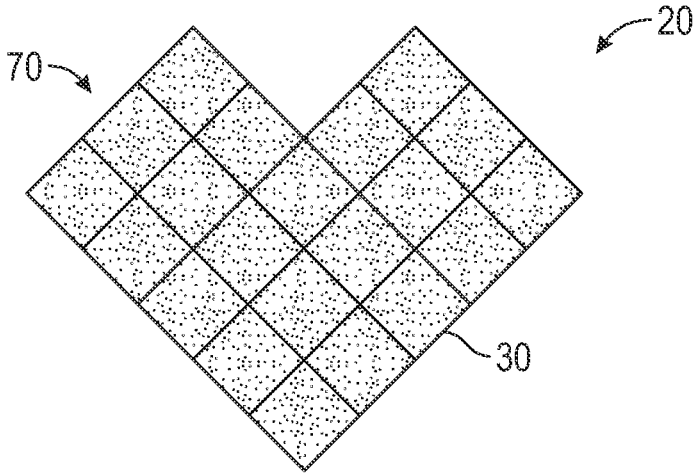
FIG. 1B is a front elevational view of the block system in another example configuration.

With reference to FIGS. 1A-10, an embodiment of a block system 20 and method will be described. The block system 20 includes a plurality of small blocks 30 that connect side by side or edge to edge using a clip such as a standard binder clip 40 that clips ridges or lips 50 of adjoining blocks together. As shown in FIGS. 1A and 2A, a plurality of blocks 30 can be joined to form various block configurations 60, 70 such as image displays. The blocks 40 may have images, numbers, letters, symbols, logos, characters, or other indicia adhered to or printed on the top or front that when collectively joined together form pictures, collages, images, letters, or other designs. The block system 20 may be rested on a horizontal surface or mounted to a vertical surface or wall 80 using a circular cleat 90 that protrudes from the wall 80 to catch the ridge or lip 50 on the block 30 to suspend it.

Figure 2A:
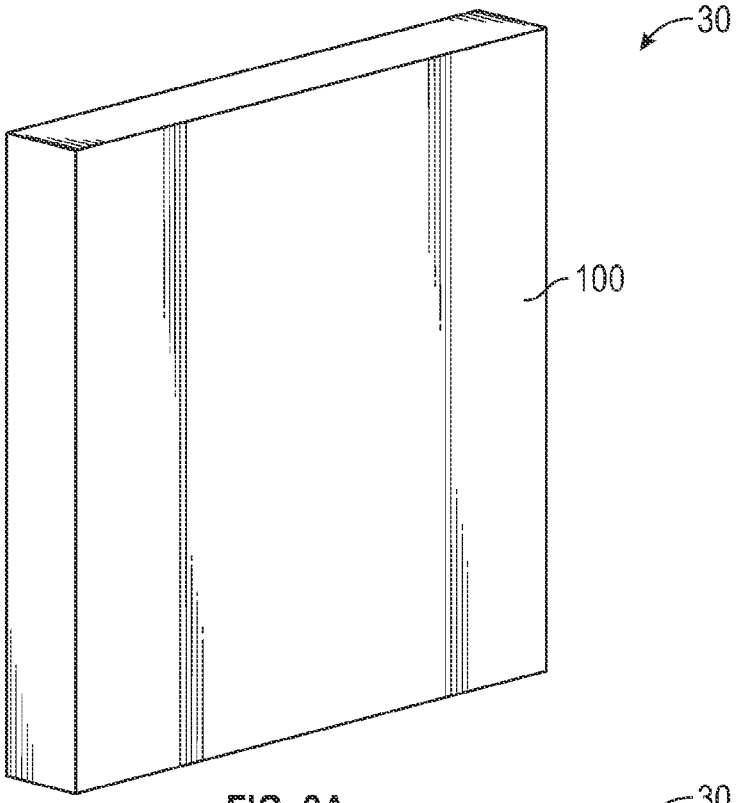
FIG. 2A is a front perspective view of an embodiment of a block of the block system.
Figure 2B:
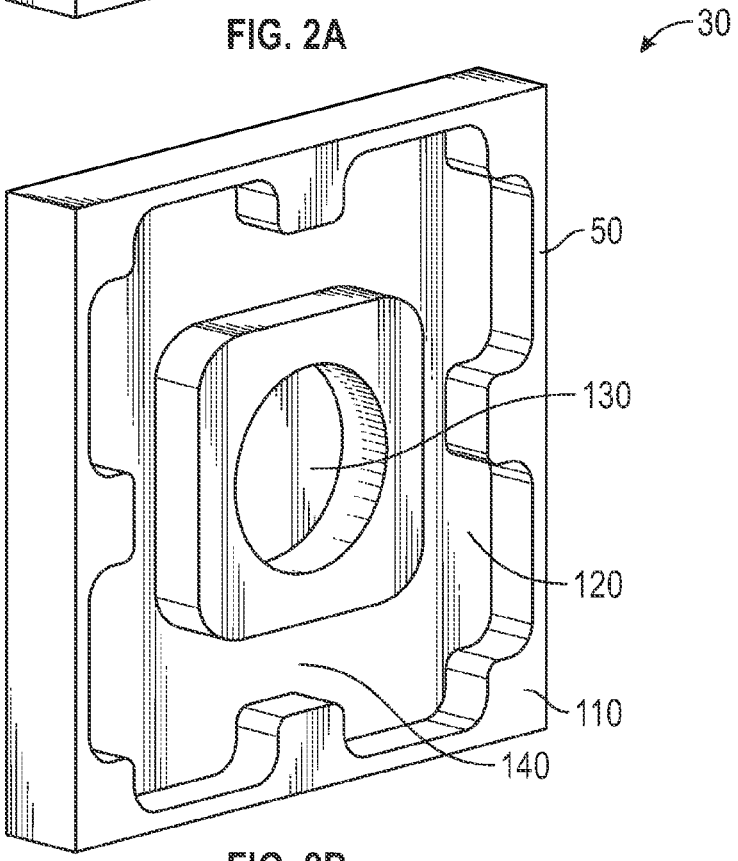
FIG. 2B is a rear perspective view of the block of the block system.
Figure 3A:
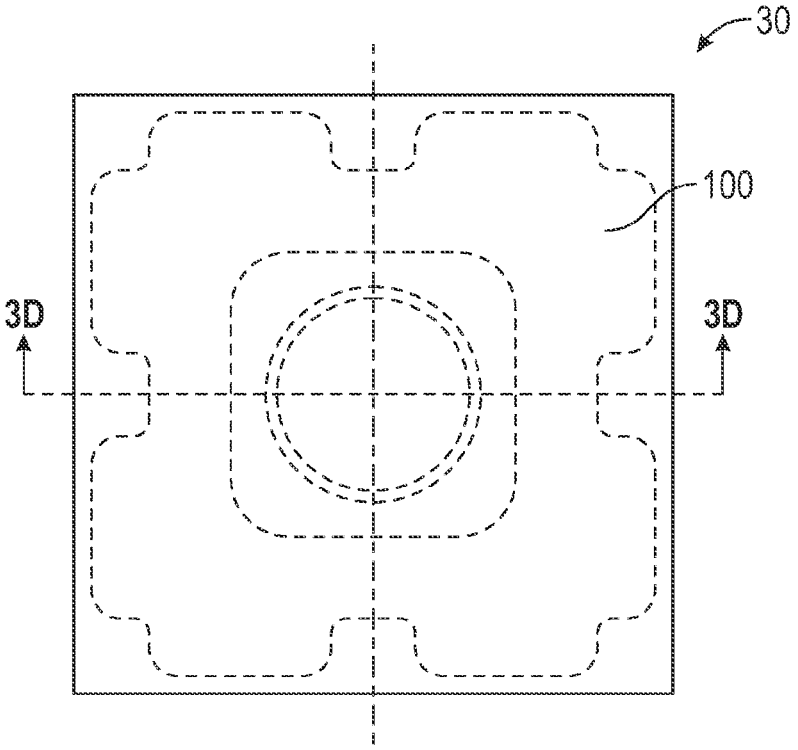
FIG. 3A is a front elevational view of the block of the block system.
Figure 3B:
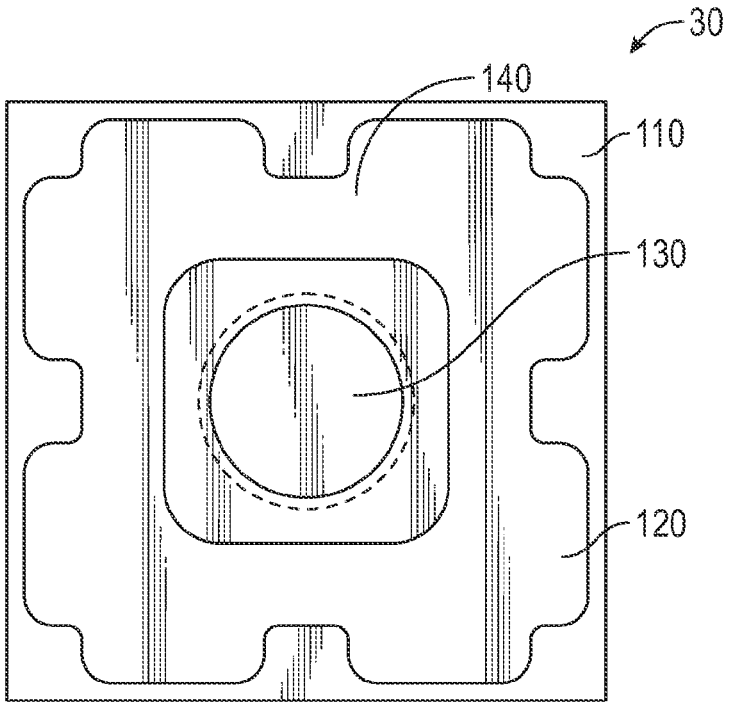
FIG. 3B is a rear elevational view of the block of the block system.
Figure 3C:
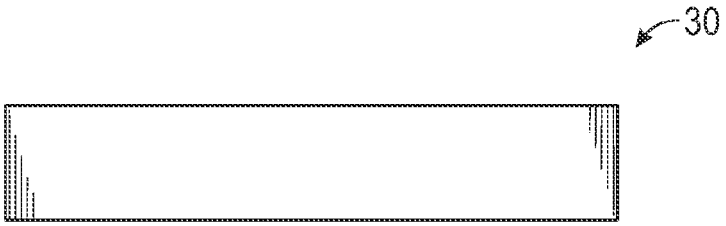
FIG. 3C is a bottom plan view of the block of the block system.
Figure 3D:
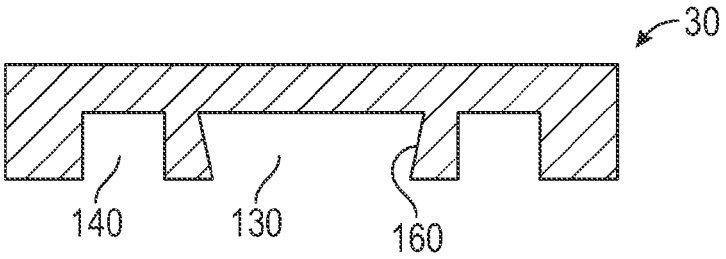
FIG. 3D is a cross-sectional view of the block of the block system taken along lines 3D-3D of FIG. 3A.

With reference to FIGS. 2A and 2B, each block 30 has a top/front 100. Images, numbers, letters, symbols, logos, characters, or other indicia are adhered to the top/front 100 of the block 30 using any of various methods such as, but not limited to, transfer sheets and direct printing. Adhering images to the material eliminates the use of glass such as with picture frames, which can break. Furthermore, adhering images to the top/front 100 allows a full bleed effect to be achieved, in which the image covers the top surface entirely, without the use of a frame member such as with picture frames.

Figure 7:
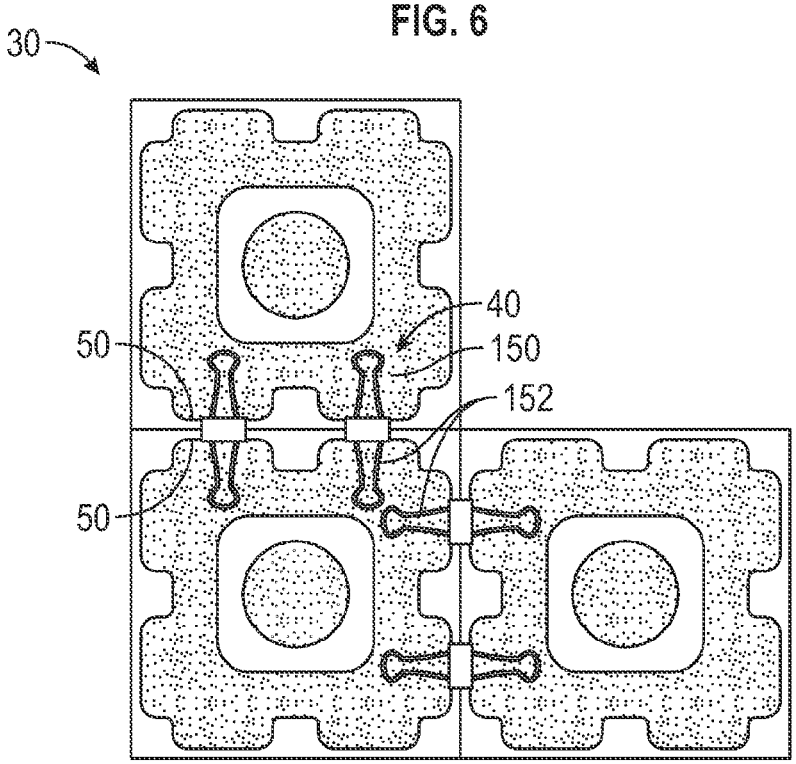
FIG. 7 is a rear elevational view of an example configuration of blocks of the block system connected together by binder clips.

The block 30 has a bottom/rear 110 with a series of edge recesses 120 that in order to allow for connecting a plurality of the blocks 30 together with the binder clips 40 at adjacent ridges/lips 50 of adjacent blocks 30. The block 30 is molded of a plastic material or made of wood and milled from a wooden or plywood blank in which circular inner recess 130 and rectangular outer recess 140 (along with edge recesses 120) is created from a subtractive process on a CNC machine. The outer rectangular recess 140 includes binder clip handle accommodating spaces 150 (FIG. 7). Each binder clip 40 includes an elongated clip member 151 with a substantially triangular cross section. Key-hole shaped handles 152 are pivotally connected to terminal ends of the clip member 151. The binder clip handle accommodating spaces 150 receive the key-hole shaped handles 152 of the binder clips 40 when clamping the lips 50 of adjacent blocks 30 together. As shown in FIG. 7, the binder clip handle accommodating spaces 150 are sized, configured, and oriented so that the handles 152 of the binder clips 40 do not overlap/contact each other and so that the handles 152 of binder clips 40 connecting perpendicularly disposed block systems 20 are perpendicularly disposed relative to each other without contacting each other.

Figure 4:
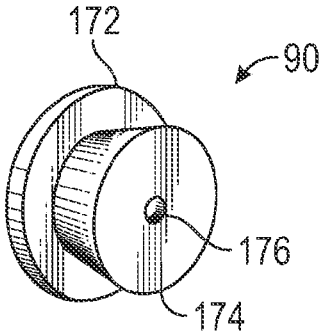
FIG. 4 is a perspective view of an embodiment of a wall cleat for the block system.

As shown in FIGS. 3D-6, the circular inner recess 130 has an angled wall 160. This circular inner recess 130 receives and rests on a circular wall cleat 90 (FIGS. 4-5C). The circular wall cleat 90 has flange portion 172, a cleat portion 174, and a central hole 176 through the flange portion 172 and the cleat portion 174 for receiving a threaded fastener 178. The cleat portion 174 includes a complementary angled wall 180 that operatively corresponds (and forms a contact point) with the angled wall 160 of the block 30 to lock the block 30 and wall cleat 90 together by the combined forces of gravity and friction. This allows slight adjustment when hanging the block system 20 on the wall 80 to ensure plumb and level.

Figure 5A:
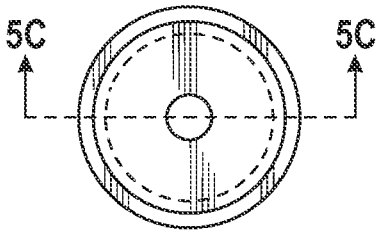
FIG. 5A is a front elevational view of the wall cleat.
Figure 5B:
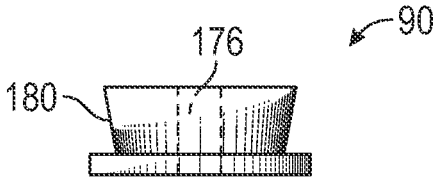
FIG. 5B is a bottom plan view of the wall cleat.
Figure 5C:
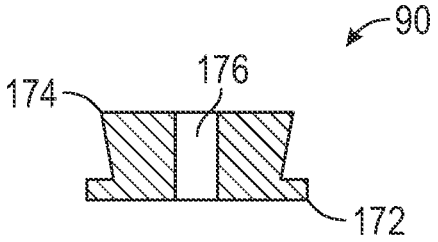
FIG. 5C is a cross-sectional view of the wall cleat.
Figure 5D:
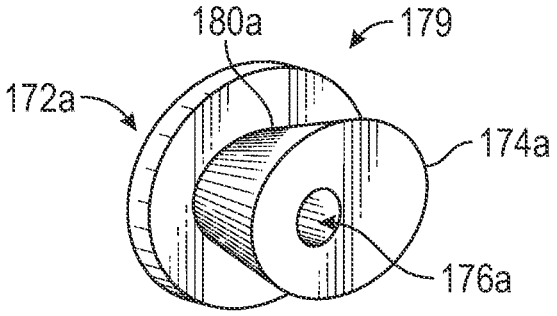
FIG. 5D is a perspective view of an alternative embodiment of a wall cleat.
Figure 6:
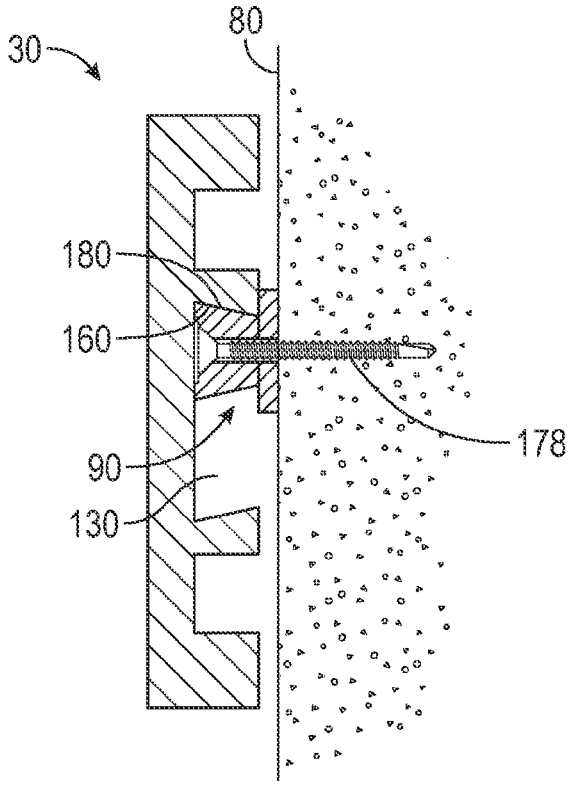
FIG. 6 is a cross-sectional view of the block of the block system shown applied to the wall cleat mounted to a wall surface.

FIG. 5D shows an alternative embodiment of an elliptical wall cleat 179 that is similar to the wall cleat 90 except both a flange portion 172*a* and a complimentary angled wall 180*a*/cleat portion 174*a* are elliptical instead of circular and a hole 176*a* is off centered or offset from center in the cleat portion 174*a*. The benefit to the elliptical cleat 179 is that it provides another mechanism for leveling the blocks 30 when attached to a vertical surface. The user rotates the cleat 179 in which the contact point raises or lowers, thus allowing for adjustments, without having to change the position of the threaded fastener 178.

In use, the images, numbers, letters, symbols, logos, characters, or other indicia are adhered to the top/front 100 of each block 30 such as by, but not limited to, transfer sheets and direct printing. The blocks 30 are turned over, top/front 100 down, on a flat surface such as a table, and assembled into a desired configuration. The binder clips 40 are then applied over adjacent lips 50 of adjacent blocks 30 to lock the blocks 30 in place into the desired configuration with the handles 152 of the binder clips 40 disposed in the binder clip handle accommodating spaces 150. The block system 20 may then be turned over, bottom/rear 110 down, onto a flat surface or applied to wall 80. To apply the block system 20 to the wall 80, the circular cleat 90 is mounted to the wall 80 with the threaded fastener 178. Then, select circular inner recesses 130 of the block system 20 are applied over the circular cleats 90 so that the complementary angled wall 160 of the blocks 30 rests on the complementary angled wall 180 of the cleat portion 174 of the cleats 90, securing the block system 20 to the cleats 90 (by the combined forces of gravity and friction). The cleat system allows slight adjustments to ensure plumb and level.

Figure 8A:
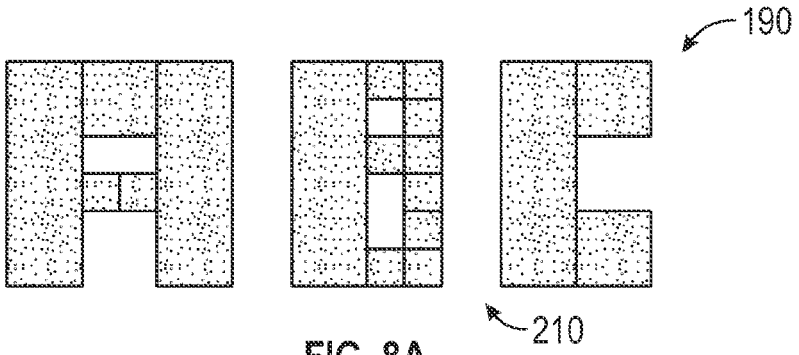
FIG. 8A is a front elevational view of another embodiment of a block system in an example configuration.
Figure 8B:
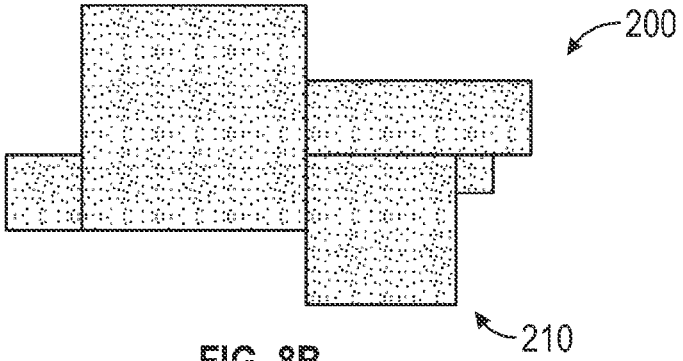
FIG. 8B is a front elevational view of another example configuration of a block system.
Figure 9A:
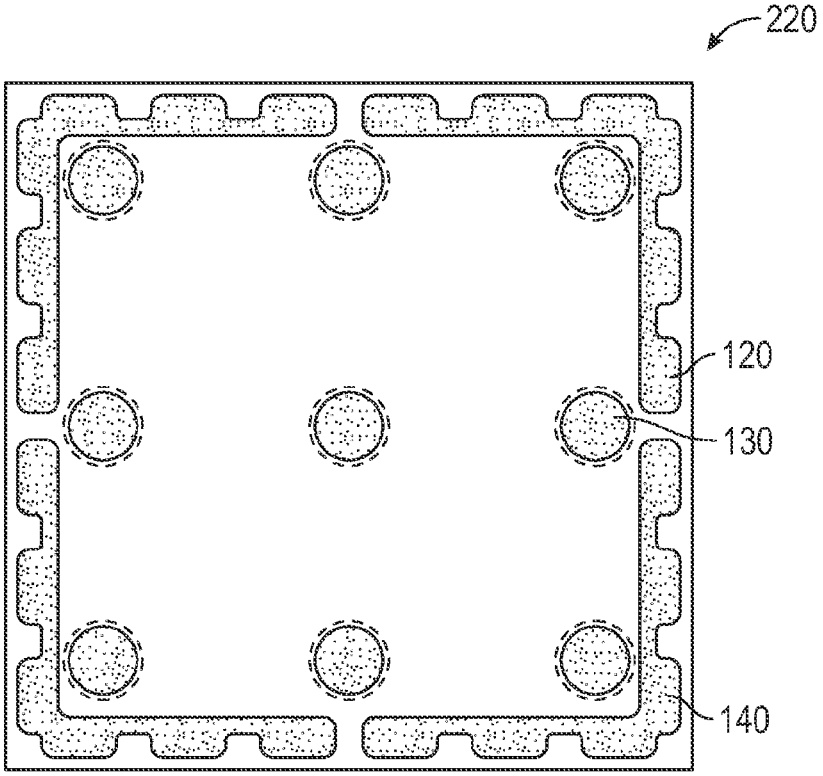
FIGS. 9A-9E are rear elevational views of embodiments of different exemplary blocks of the block system(s) shown in FIGS. 8A and 8B.
Figure 9B:
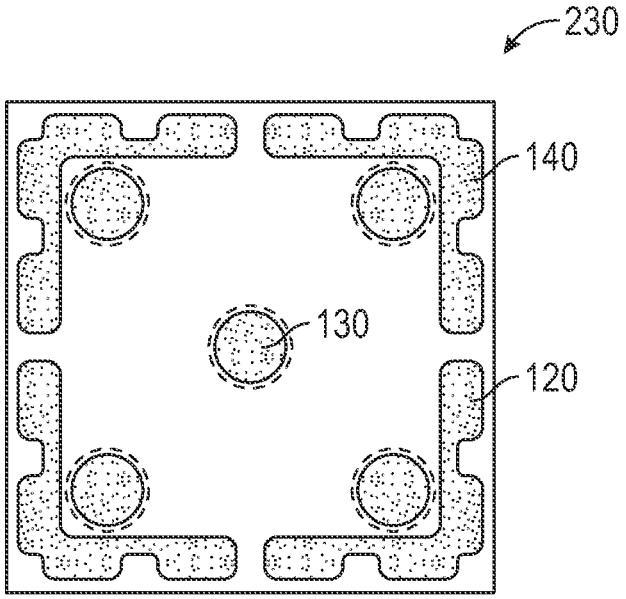
Figure 9C:
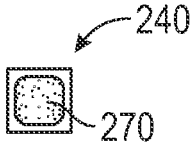
Figure 9D:
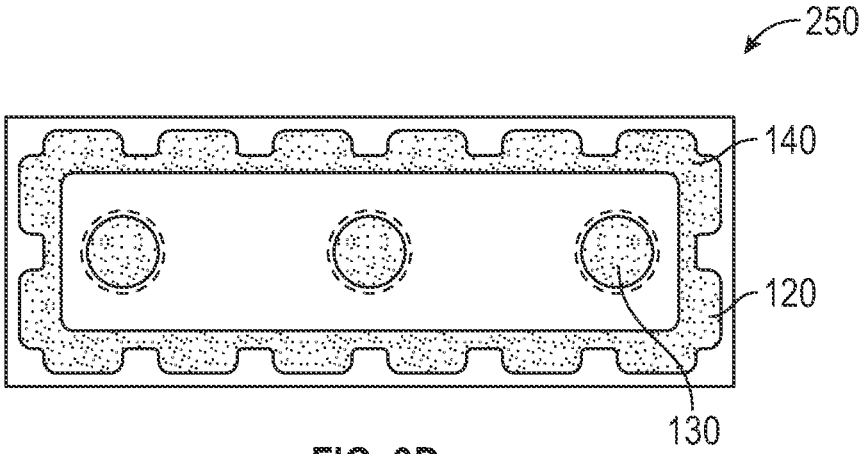
Figure 9E:
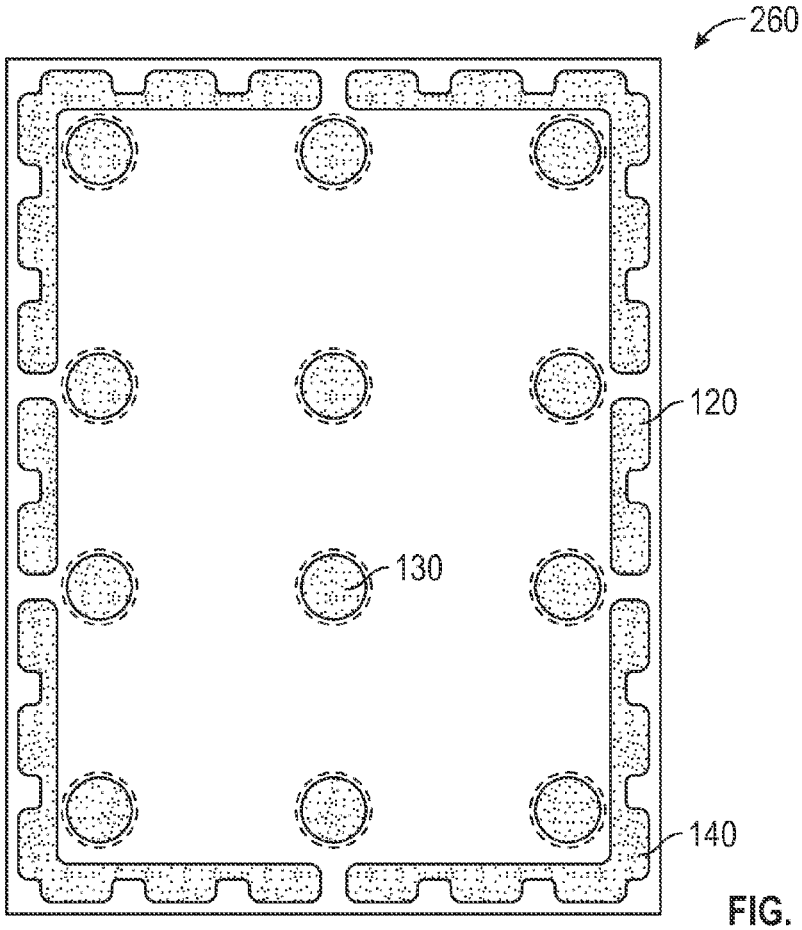
Figure 10:
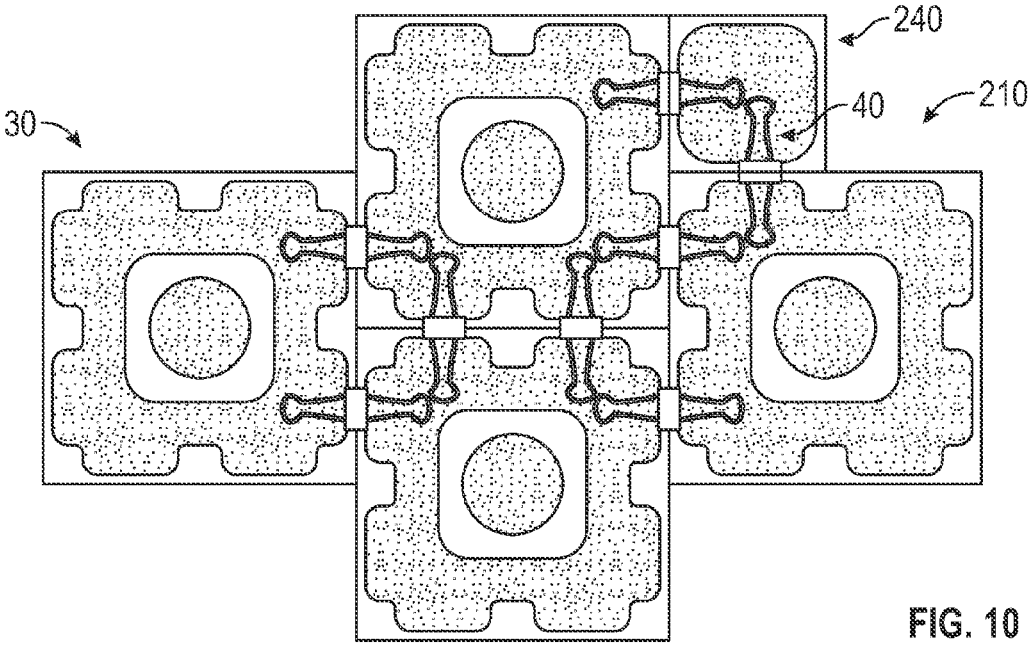
FIG. 10 is a rear elevational view of an example configuration of blocks of the block system(s) shown in FIGS. 8A-9E connected together by binder clips.

FIGS. 8A, 8B, and FIG. 10 show further exemplary block configurations 190, 200, 210 made from a further embodiment of a block system 210 that includes one or more of different sized/shaped blocks 220 (FIG. 9A), 230 (FIG. 9B), 240 (FIG. 9C), 250 (FIG. 9D), and/or 260 (FIG. 9E). Similar to the block 30, the blocks 220, 230, 250, 260 are rectangular and include edge recesses 120 for receiving binder clips 40 (FIG. 10) to hold the blocks 220, 230, 240, 250, 260 together and include circular inner recesses 130 (with angled walls) for mounting recesses to circular cleats 90 in a manner similar to that described above. Small block 240 has substantially rectangular interior recess 270. As shown by FIGS. 9A-9E, the configuration, size, positioning, and/or number of recesses 120, 130, 140 may vary, depending on the desired block size and shape.

While various embodiments of the present invention have been described above, it should be understood that they have been presented by way of example only, and not of limitation. Likewise, the various diagrams may depict an example architectural or other configuration for the disclosure, which is done to aid in understanding the features and functionality that can be included in the disclosure. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent.

While illustrative embodiments of the invention are disclosed herein, it will be appreciated that numerous modifications and other embodiments can be devised by those skilled in the art. Features of the embodiments described herein, can be combined, separated, interchanged, and/or rearranged to generate other embodiments. Therefore, it will be understood that the present application is intended to cover all such modifications and embodiments that come within the spirit and scope of the present invention.

What is claimed:

1. A block system, comprising:

a plurality of blocks connected side by side into a configuration, each block including a front, a rear, sides, lips, and fastener accommodating spaces;

a plurality of adjacent fasteners connecting side by side blocks together;

a wall cleat with a flange and a cleat portion having an angled wall and a hole for receiving a threaded fastener for mounting the wall cleat to a wall, each block including an angled wall that defines a circular inner recess not extending through the block that operatively corresponds with the angled wall of the wall cleat to lock the block and wall cleat together by the combined forces of gravity and friction;

wherein each fastener is disposed in the fastener accommodating spaces of side by side blocks without overlapping adjacent fasteners and the cleat portion is elliptical and the hole is offset from center in the cleat portion.

2. The block system of claim 1, wherein the fasteners are binder clips that clip together adjacent lips of adjacent blocks for clipping the plurality of blocks together in the side by side configuration.

3. A block system, comprising:

a plurality of blocks connected side by side into a configuration, each block including a front, a rear, sides, lips, and fastener accommodating spaces;

a plurality of adjacent fasteners connecting side by side blocks together;

wherein each fastener is disposed in the fastener accommodating spaces of side by side blocks without overlapping adjacent fasteners, the fasteners are binder clips that clip together adjacent lips of adjacent blocks for clipping the plurality of blocks together in the side by side configuration, each binder clip includes an elongated clip member with a substantially triangular cross section and terminal ends, and a pair of key-hole shaped handles pivotally connected to terminal ends of the clip member.

4. The block system of claim 3, wherein the block is made of at least one of a wood material and a plastic material.

5. The block system of claim 4, wherein the block is made of a wood material and milled from at least one of a wooden blank and a plywood blank in which a circular inner recess, a rectangular outer recess, and edge recesses are created from a subtractive process on a CNC machine.

6. The block system of claim 3, wherein the fastener accommodating spaces receive the key-hole shaped handles of the binder clips without overlapping adjacent key-hole shaped handles of adjacent fasteners.

7. The block system of claim 6, wherein the block system includes perpendicularly disposed blocks, and the fastener accommodating spaces receive the key-hole shaped handles of the binder clips without overlapping adjacent key-hole shaped handles of adjacent fasteners and so that the key-hole shaped handles of binder clips connecting perpendicularly disposed blocks are perpendicularly disposed relative to each other without contacting each other.

8. The block system of claim 3, further including a wall cleat with a flange and a cleat portion having an angled wall and a hole for receiving a threaded fastener for mounting the wall cleat to a wall, each block including an angled wall that defines a circular inner recess not extending through the block that operatively corresponds with the angled wall of the wall cleat to lock the block and wall cleat together by the combined forces of gravity and friction.

9. The block system of claim 8, wherein the cleat portion is circular and the hole is centrally disposed in the cleat portion.

10. The block system of claim 8, wherein the cleat portion is elliptical and the hole is offset from center in the cleat portion.

11. The block system of claim 3, wherein the front of each block includes at least one of images, numbers, letters, symbols, logos, characters, and indicia adhered to the front by at least one of transfer sheeting and direct printing.

12. The block system of claim 3, wherein the front of each block is solid and the rear of each block includes the fastener accommodating spaces.

13. The block system of claim 3, wherein the blocks include rectangular blocks.

14. The block system of claim 3, wherein the blocks include square blocks.

15. A method of using the block system of claim 3, comprising:

aligning a plurality of the blocks rear face up side by side into the configuration;

connecting the side by side blocks together with the plurality of adjacent fasteners so that the fasteners are disposed in the fastener accommodating spaces of side by side blocks without overlapping adjacent fasteners.

16. The method of claim 15, wherein the block system includes at least one wall cleat with a flange and a cleat portion having an angled wall, each block includes an angled wall that defines a circular inner recess that operatively corresponds with the angled wall of the wall cleat, the method further including:

mounting the at least one wall cleat to the wall;

mounting the block system to the wall by disposing the wall cleat in the circular inner recess of the block so that the angled wall defining the circular inner recess locks the block and wall cleat together by the combined forces of gravity and friction.

17. The method of claim 16, further including adjusting the block system on the cleat to ensure plumb and level.

18. The method of claim 16, wherein the cleat portion is elliptical, and further including rotating the cleat so that a contact point of the cleat with the block system raises or lowers, allowing for adjustments of the block system.

19. The block system of claim 3, wherein one or more fastener accommodating spaces are elongated and together with one or more sides form one or more straight lips.

20. A block system, comprising:

a plurality of blocks connected side by side into a configuration, each block including a front, a rear, sides, lips, and fastener accommodating spaces, the rear including an angled wall defining an inner recess that does not extend through the block;

a plurality of adjacent fasteners connecting side by side blocks together;

wherein each fastener is disposed in the fastener accommodating spaces of side by side blocks without overlapping adjacent fasteners;

a wall cleat with an elliptical cleat portion and a hole for receiving a threaded fastener for mounting the wall cleat to a wall, the angled wall of the cleat portion operatively corresponding with the angled wall defining the inner recess of the block to lock the block and wall cleat together by the combined forces of gravity and friction.

* * * * *